United States Patent [19]

Luisi et al.

[11] 4,078,942

[45] Mar. 14, 1978

[54] METHOD AND APPARATUS FOR CLEANING STRIP IN A MOLTEN SALT BATH

[75] Inventors: Frank L. Luisi, Apollo; Philip R. Robinson, New Kensington; Roy C. Bongartz, Pittsburgh, all of Pa.

[73] Assignee: Allegheny Ludlum Industries, Inc., Pittsburgh, Pa.

[21] Appl. No.: 761,170

[22] Filed: Jan. 21, 1977

[51] Int. Cl.[2] ..... B08B 3/10

[52] U.S. Cl. ..... 134/10; 134/15; 134/34; 134/104; 134/108; 134/109; 134/122 R; 134/182; 134/184; 134/193; 266/107

[58] Field of Search ..... 134/15, 34, 64, 122 R, 134/188, 193, 104, 105, 108, 184, 182, 109, 10; 266/107, 120, 131

[56] References Cited

U.S. PATENT DOCUMENTS

| | | | |
|---|---|---|---|
| 2,635,062 | 4/1953 | Dunlevy et al. | 134/122 X |
| 2,738,294 | 3/1956 | Spence | 134/15 X |
| 2,783,892 | 3/1957 | Faler | 134/108 X |
| 2,788,790 | 4/1957 | Jordan | 134/108 |
| 2,863,465 | 12/1958 | Shoemaker et al. | 134/104 |
| 2,967,530 | 1/1961 | Shoemaker et al. | 134/108 |
| 3,393,689 | 7/1968 | Faler | 134/104 |
| 3,592,205 | 7/1971 | Sheppard | 134/104 |

*Primary Examiner*—S. Leon Bashore
*Assistant Examiner*—Marc L. Caroff
*Attorney, Agent, or Firm*—Vincent G. Gioia; Robert F. Dropkin

[57] ABSTRACT

Strip is cleaned by passing it through a molten salt bath in a rectangular tank having U-shaped heating tubes arranged horizontally along each longitudinal side of the tank. Agitators positioned within L-shaped ducts at diagonally opposite corners of the tank cause movement of the bath past the heating tubes, thus heating the bath uniformly and keeping it in motion to prevent sludge from settling out. A second tank arranged along one side of the main tank has two spaced apart openings into the main tank and an agitator which causes movement of molten salt therethrough. The second tank also has a settling chamber therein through which molten salt passes slowly so as to cause sludge to settle out.

7 Claims, 5 Drawing Figures

METHOD AND APPARATUS FOR CLEANING STRIP IN A MOLTEN SALT BATH

This invention relates to a method and apparatus for cleaning strip and more particularly to cleaning strip passing through a molten salt bath at a temperature of approximately 900° F. Such method and apparatus are old and well known, both for batch and continuous processes. Art of which we have knowledge are Faler U.S. Pat. Nos. 2,783,892 dated Mar. 5, 1957, and 3,393,689 dated July 23, 1968, Shoemaker et al. U.S. Pat. Nos. 2,863,465 dated Dec. 9, 1958 and 2,967,530 dated Jan. 10, 1961 and Sheppard U.S. Pat. No. 3,592,205 dated July 13, 1971. All of this prior art have various disadvantages. It is necessary that the sludge resulting from the cleaning operation be prevented from settling in the cleaning tank or on heating tubes which requires circulating the bath. It is also necessary to heat the molten salt bath. For some reason, perhaps due to the heating arrangement in some cases, it has been the belief of many of those skilled in the art that the bath be deep, such as five or six feet. This of course requires additional space and is more expensive than having a shallow bath. In many instances the heating coils are outside the main cleaning tank and the heating is thus more expensive. In many instances the heating arrangement is such that the heating tubes are subject to attack by the bath and/or the sludge in the bath. The arrangement of the sludge removal system is often expensive or not efficient.

It is therefore an object of our invention to provide apparatus for cleaning strip in a molten salt bath which permits a shallower tank than those in general use.

Another object is to provide such apparatus which protects the heating tubes located in the bath from damage therefrom.

Still another object is to provide such apparatus which is relatively inexpensive to build and operate.

A further object is to provide a method of cleaning strip which is relatively inexpensive and which includes efficient eating and circulation of the molten salt bath.

These and other objects will be more apparent after referring to the following specification and attached drawings in which.

Figure 1:
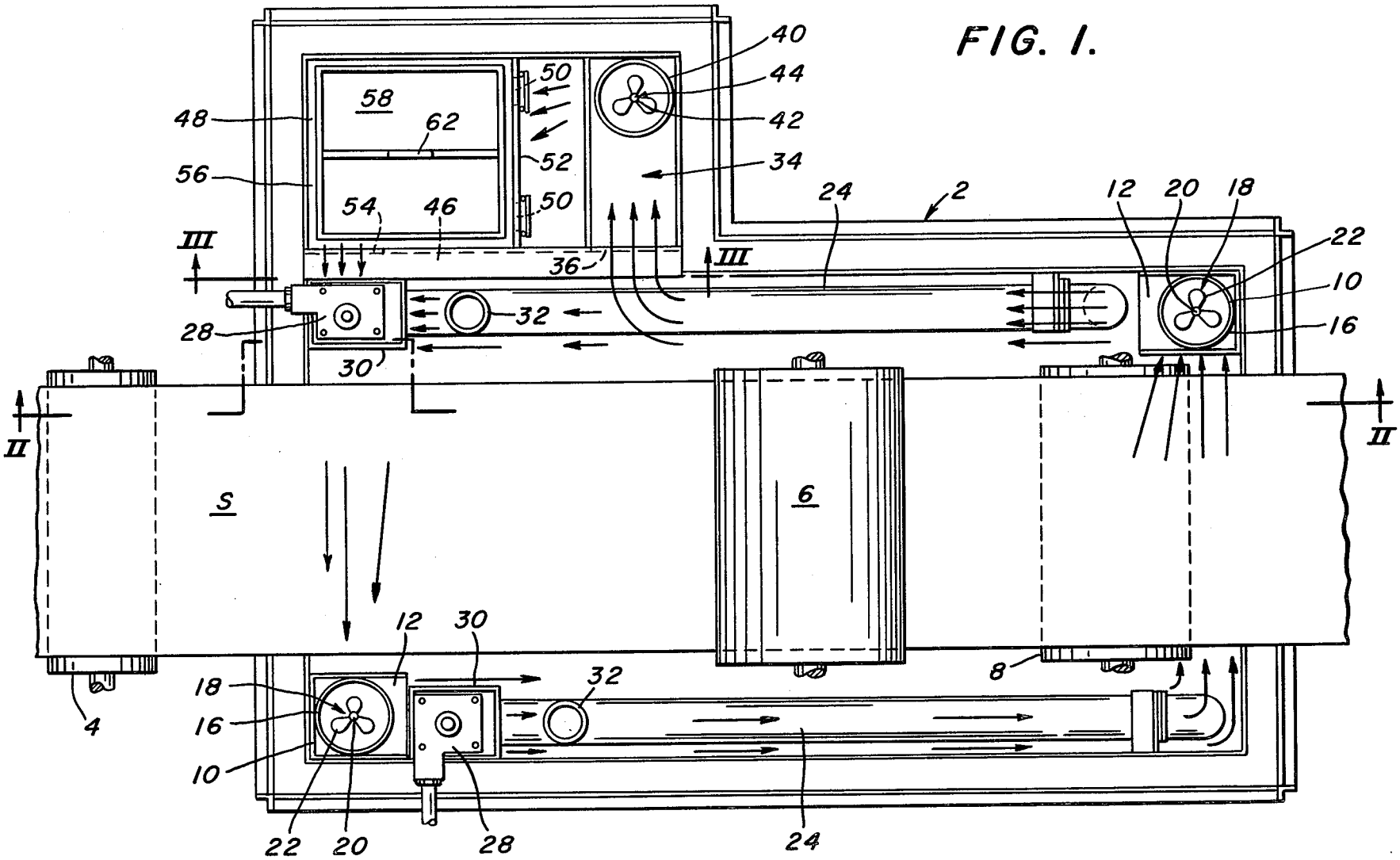
FIG. 1 is a somewhat schematic top plan view of the apparatus of our invention.
Figure 2:
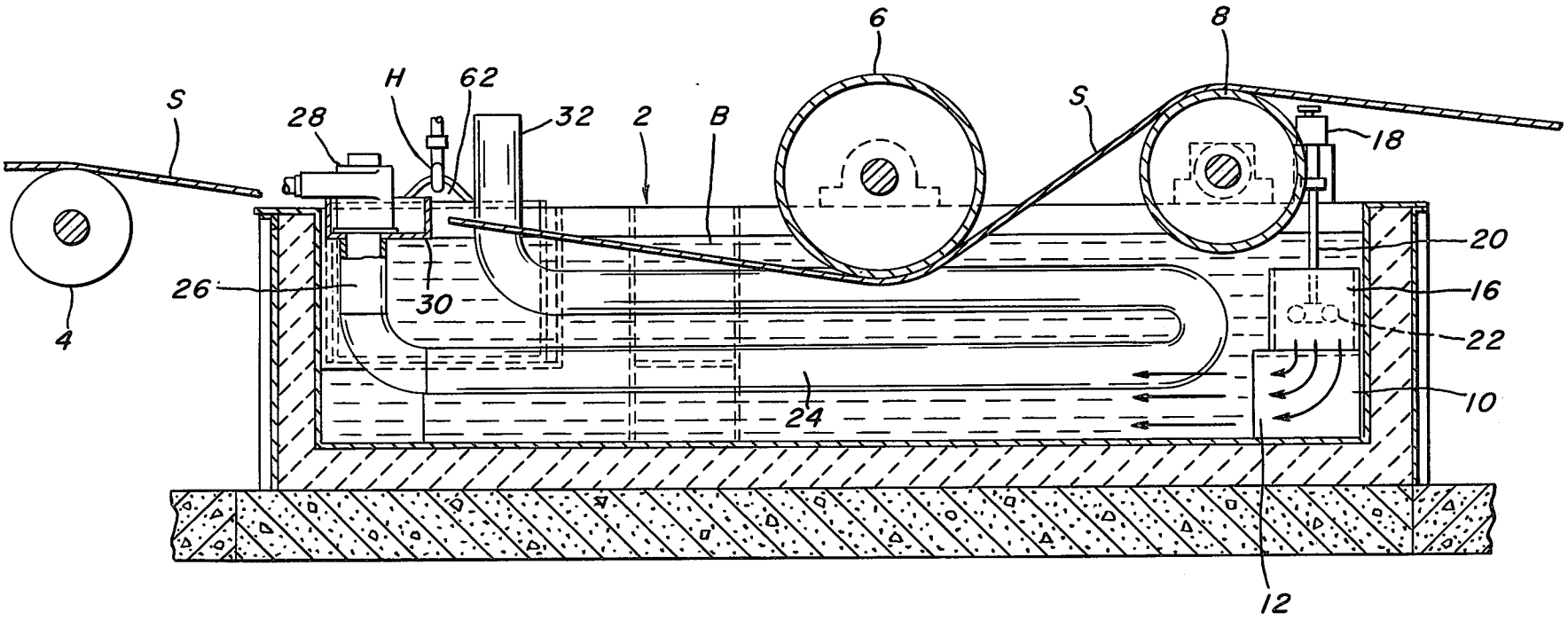
FIG. 2 is a view taken on the line II—II of FIG. 1.
Figure 3:
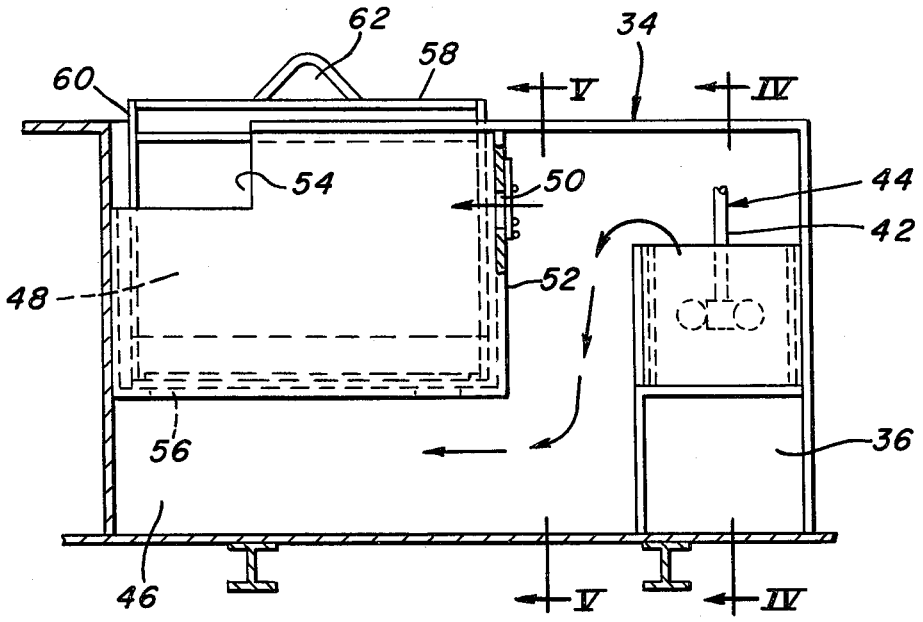
FIG. 3 is a view taken on the line III—III of FIG. 1.
Figure 4:
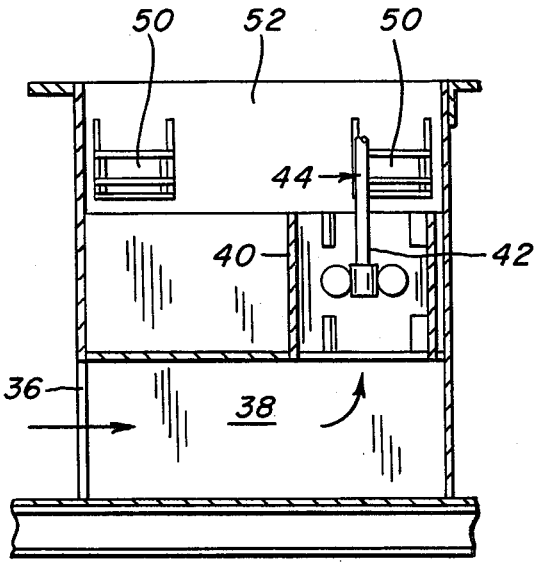
FIG. 4 is a view taken on the line IV—IV of FIG. 3.
Figure 5:
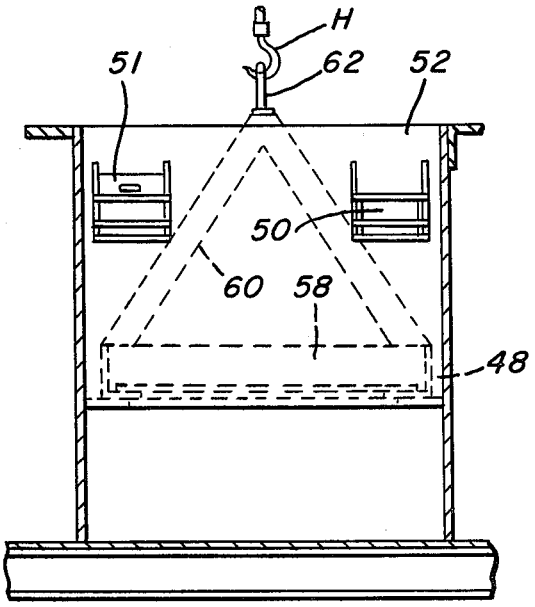
FIG. 5 is a view taken on the line V—V of FIG. 3.

Referring more particularly to the drawings, reference numeral 2 indicates a generally rectangular main tank for containing a molten salt bath B. A strip S to be cleaned is directed into the bath over entry roll 4, beneath sink roll 6 and over roll 8 in the usual manner. According to our invention we provide an L-shaped duct 10 at diagnally opposite corners of tank 2. Each duct includes a horizontal leg 12 having a discharge opening extending away from the adjacent end of the tank and an upwardly extending leg 16 terminating beneath the level of the bath. A standard agitator 18 has its shaft 20 extending into each horizontal leg with a propeller 22 at its lower end. A U-shaped heating tube 24 is arranged along each longitudinal side of tank 2 with the legs of the tube generally horizontal. This enables the tank 2 to be relatively shallow as compared to those in general use prior to our invention. For example, the overall depth of our tank in one particular installation is only 3 feet deep as compared to the usual 5 or 6 feet and the depth of the bath beneath the sink roll 6 is only about 2 feet. The lower leg of the tube 24 has a vertical leg 26 connected to its free end and a gas or oil burner 28 connected to the top of leg 26. The vertical leg 26 is connected to a liquid tight box 30 having its bottom approximately at the top of the bath B. We have found that this arrangement prevents or greatly retards burning or erroding of the tube 24 adjacent the top of the bath. The combustion gases exhaust through a vertical leg 32 connected to the upper horizontal leg of the tube 24. It will be seen that the tubes 24 extend for the majority of the length of the tank 2, but with spaces at each end. Each burner 28 is shown as located at the forward or entry end of the tank with that at the right side being spaced from the end to provide room for the duct 10.

A second tank 34 is connected to the forward end of the left side of tank 2. The tank 34 has a bottom inlet 36 opening 6 to a bottom chamber 38 having a duct 40 extending upwardly from its remote end for receiving rotor 42 of agitator 44 similar to agitators 18. The tank 34 has a bottom outlet 46 to the main tank 2 at its forward end and a settling chamber 48 above outlet 46. The chamber 48 has two small inlet openings 50 adjacent the top thereof in its rear wall 52 and a small outlet opening 54 to tank 2 adjacent its top. The chamber 48 has a large bottom opening 56 and is adapted to receive a sludge pan 58 which covers the opening 56. The pan 58 has an upwardly extending bracket 60 with an opening 62 for receiving a crane hook H.

In operation, strip S passes through the tank 2 and is cleaned by contact with the molten salt bath B. This tends to agitate or keep the bath in motion to help keep the sludge from settling out. However, the majority of the agitation or circulation is obtained by means of the agitators 18 with some help from the agitator 44. As shown by the arrows this causes molten salt from the upper portion of the bath adjacent the entry end of the tank 2 to pass downwardly and then along the right side of the tank and then across the rear of the tank, this latter motion being assisted by the rear agitator 18 which also moves the molten salt along the left side of the tank. The agitator 44 pulls some of the molten salt into tank 34 and circulates it therethrough and back into tank 2 toward entry agitator 18. This movement prevents build up of sludge on the heating tubes 24 or on the bottom of the tank adjacent the heating tubes, thus keeping the heating tubes in good condition. At the same time heat from the heating tubes is delivered to the molten salt passing therearound which in turn keeps the temperature of the entire bath substantially constant. A relatively small portion of the molten salt passes through openings 50 into chamber 48 and out through opening 54. Since the molten salt moves slowly in chamber 48 the sludge therein will settle out and collect in sludge pan 58. The pan 58 is removed by means of a crane from time to time as sludge collects thereon.

While one embodiment has been shown and described, it is to be understood that various adaptations and modifications may be made within the scope of the invention.

We claim:

1. Apparatus for cleaning strip comprising a generally rectangular main tank containing a molten salt bath, means for directing strip through said salt bath below the top thereof, a U-shaped heating tube having generally horizontal legs extending along each longitudinal side of said tank for the majority of its length with a space at each end thereof, a forward L-shaped duct located at one forward corner of said tank with a horizontal leg extending along the longitudinal tank side adjacent said one forward corner with a discharge opening at its rear end and a vertical leg extending upwardly to a level below the top of said bath, an agitator in said vertical leg of said forward duct for pulling molten salt downwardly through said duct and discharging it through said discharge opening along the adjacent longitudinal side, a rear L-shaped duct located at a rear corner of said tank diagonally opposite said one forward corner with a horizontal leg extending along the longitudinal tank side adjacent said rear corner with a discharge opening at its forward end and a vertical leg extending upwardly to a level below the top of said bath, and a second agitator in said vertical leg of said rear duct for pulling molten salt downwardly through said duct and discharging it through said discharge opening along the adjacent longitudinal side.

2. Apparatus for cleaning strip according to claim 1 including an upwardly extending vertical leg connected to one horizontal leg of each heating tube, a burner connected to the top of each of said vertical legs, and a liquid proof box for receiving each vertical leg with the bottom of said box being at about the top of said bath.

3. Apparatus for cleaning strip according to claim 1 including a second tank along one longitudinal side of said main tank and having bottom inlet and outlet openings to said main tank, a third agitator in said second tank for pulling bath from said main tank through said bottom inlet and discharging it from said bottom outlet, and a sludge settling chamber in said second tank above said outlet and having a relatively small upper inlet opening from said second tank and a relatively small upper outlet opening to said main tank.

4. Apparatus for cleaning strip according to claim 3 including an upwardly extending vertical leg connected to one horizontal leg of each heating tube, a burner connected to the top of each of said vertical legs, and liquid proof box for receiving each vertical leg with the bottom of said box being at about the top of said bath.

5. Apparatus for cleaning strip comprising a generally rectangular main tank containing a molten salt bath, means for directing strip through said salt bath below the top thereof, the bottom of said tank being a relatively short distance below the bottom of said strip in said bath, a heating tube along each longitudinal side of said tank within said tank below said bath level, each of said heating tubes including generally parallel horizontal legs connected at one end by a U-bend and having a generally vertical upwardly extending leg at the other end, the vertical leg of a lower horizontal leg being adjacent an end of said tank and having a burner attached to the top thereof, a liquid proof box for receiving the vertical leg of the lower horizontal leg with the bottom of said box being at about the top of said bath, the vertical leg of an upper horizontal leg being adjacent the corresponding vertical leg of the lower horizontal leg, a forward L-shaped duct located at one forward corner of said tank with a horizontal leg extending along the longitudinal tank side adjacent said one forward corner with a discharge opening at its rear end and a vertical leg extending upwardly to a level below the top of said bath, an agitator in said vertical leg of said forward duct for pulling molten salt downwardly through said duct and discharging it through said discharge opening along the adjacent longitudinal side, a rear L-shaped duct located at a rear corner of said tank diagonally opposite said one forward corner with a horizontal leg extending along the longitudinal tank side adjacent said rear corner with a discharge opening at its forward end and a vertical leg extending upwardly to a level below the top of said bath, a second agitator in said vertical leg of said rear duct for pulling molten salt downwardly through said duct and discharging it through said discharge opening along the adjacent longitudinal side, a second tank along a forward portion of said longitudinal side of said main tank having the rear duct at its rearward end, said second tank having a rear inlet from the main tank and a forward outlet to the main tank both adjacent the bottom thereof, a sludge settling chamber in said second tank located above the said forward outlet and having a vertical rear wall with a small opening adjacent its top, a third agitator in said second tank for pulling bath from said main tank through said rear inlet and discharging it from said forward outlet, a small opening from said settling chamber to said main tank, and means in said settling chamber for receiving settled out sludge.

6. The method of cleaning strip comprising passing said strip longitudinally through a molten salt bath in a generally rectangular tank having longitudinal sides, an entry end wall and an exit end wall, heating said bath by contact with heated U-shaped tubes in said tank one along each longitudinal side of said tank, and agitating said bath by means of a first agitating system located at one corner of the tank adjacent the entry end wall comprising a first L-shaped duct with a horizontal leg extending along the longitudinal tank side adjacent said one corner and a vertical leg extending upwardly to a level below the top of said bath and a first agitator in said vertical leg of said first duct; which first agitating system pulls a portion of the molten bath downwardly and directs it toward the exit end wall in contact with the U-shaped tube nearest the one corner and a second agitating system located at a second corner of the tank diagonally opposite said one corner of said tank comprising a second L-shaped duct with a horizontal leg extending along the longitudinal tank side adjacent said second corner and a vertical leg extending upwardly to a level below the top of said bath and a second agitator in said vertical leg of said second duct, which pulls a portion of the molten bath downwardly and directs it toward the entry end wall in contact with the U-shaped tube nearest the second corner.

7. The method of cleaning strip according to claim 6 which includes circulating a portion of said bath by means of a third agitator through a second tank and back to said main tank, and passing a portion of said bath in said second tank slowly through a sludge removal chamber.

* * * * *